US006954539B2

(12) United States Patent
Maruta

(10) Patent No.: US 6,954,539 B2
(45) Date of Patent: Oct. 11, 2005

(54) SPEAKER

(75) Inventor: Naoto Maruta, Daito (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 10/765,577

(22) Filed: Jan. 27, 2004

(65) Prior Publication Data

US 2004/0184629 A1 Sep. 23, 2004

(30) Foreign Application Priority Data

Jan. 31, 2003 (JP) ..... 2003-000469 U

(51) Int. Cl.[7] ..... H04R 25/00
(52) U.S. Cl. ..... 381/385; 381/388; 381/333
(58) Field of Search ..... 381/305, 306, 381/333, 334, 386, 388, 394, 395; 361/681, 682, 683, 686; 248/917–920; 348/836, 838

(56) References Cited

U.S. PATENT DOCUMENTS

| | | | | |
|---|---|---|---|---|
| 3,943,564 A | | 3/1976 | Tushinsky | 360/55 |
| 4,450,495 A | * | 5/1984 | Naruki | 360/137 |
| 5,400,408 A | * | 3/1995 | Lundgren et al. | 381/306 |
| 5,435,742 A | | 7/1995 | Cecil, Jr. | 439/347 |
| 5,970,161 A | * | 10/1999 | Takashima et al. | 381/386 |

FOREIGN PATENT DOCUMENTS

| | | | |
|---|---|---|---|
| DE | 199 26 603 C 1 | 6/1999 | B04R/11/02 |
| JP | 57-23679 A | 7/1980 | |
| JP | 60-186787 | 12/1985 | |
| JP | 60-249498 | 12/1985 | H04R/1/02 |

OTHER PUBLICATIONS

Action issued Mar. 24, 2003 by the Japanese Patent Office in priority Japanese Utility Model Application No. JP 2003–000469 U, containing statement of relevance hand-written in English, 3 pgs.

* cited by examiner

*Primary Examiner*—Huyen Le
(74) *Attorney, Agent, or Firm*—Osha-Liang LLP

(57) ABSTRACT

When a speaker is detached repeatedly by sliding a connection pin over a narrow portion formed in a through hole in a cabinet, the contact portions of the narrow portion of the through hole and the connection pin wear away.

Cushion holes 28*g* and 28*h* are formed in the vicinity of the narrow portion 28*f* of the through hole 28 to deform areas sandwiched between the narrow portion 28*f* and the cushion holes 28*g* and 28*h* widely, thereby making it possible to increase the width of the narrow portion 28*f* by elastic deformation. Therefore, since the narrow portion 28*f* is elastically deformed at the time of sliding, the contact portions do not wear away and return to their original forms after sliding so that the connection pin is mated again. Accordingly, the connection pin does not slide accidentally thereafter.

9 Claims, 9 Drawing Sheets

Sectional view cut on A–A

Sectional view cut on B–B

Sectional view cut on C–C

Sectional view cut on D–D

SPEAKER

BACKGROUND OF THE INVENTION

1. Field of the Invention

The present invention relates to a speaker, specifically a speaker which can be detachable from a TV cabinet.

2. Description of the Prior Art

Heretofore, there has been known this type of speaker which is fixed by fastening a screw after a connection pin is held at a predetermined position of a cabinet and the speaker is brought close to a TV in the direction of inserting the connection pin in order to electrically connect the connection pin to a jack formed in the TV.

Since the screw is exposed on a user side and does not look nice in the above-described speaker, it is proposed that after the speaker and the TV are electrically connected to each other as described above, the speaker is slid over the TV while this connection is maintained to mate an engagement claw as fixing means which does not look bad. As specific means, a prolonged hole is formed in the cabinet to be engaged with the connection pin in such a manner that the pin can slide in the hole. In this constitution, if the pin insertion possible state of the speaker and the fixed state of the speaker are switched with each other accidentally, detaching work will become difficult. Then, as means of preventing the connection pin from sliding between the position for enabling the pin to be inserted and the position for allowing the pin to be mated accidentally, convex portions the interval between which is smaller than the width of the connection pin are formed between these positions.

However, since the connection pin is slid over the convex portions the interval between which is smaller than the width of the connection pin to detach the speaker, when detachment is repeated, the convex portions are worn away, resulting in reduced durability.

SUMMARY OF THE INVENTION

It is an object of the present invention which has been made in view of the above situation to provide a speaker which rarely experiences the wear of the above convex portions even when the speaker is detached repeatedly.

To attain the above object, according to the present invention, there is provided a speaker which comprises a signal connection pin having a columnar shape with substantially the same diameter and a small-diameter portion at a halfway position in an axial direction, a speaker unit electrically connected to the connection pin by a wire, and a cabinet for holding the speaker unit, the signal connection pin and the wire, the signal connection pin being slid over an external TV cabinet while it is connected to a connection jack formed in the TV cabinet so that an engagement claw formed on the cabinet engages with the TV cabinet and further the speaker being fixed by a screw, wherein a prolonged through hole into which the signal connection pin is inserted and slid is formed in the bottom of the cabinet, one end of the through hole is made a first position which is an opening for preventing the signal connection pin from sliding by means of a seal plate provided on other member in an assembly state, having a diameter wide enough to accept the signal connection pin, the other end of the through hole is made a second position having a slightly small opening diameter so that it is loosely mated with the small-diameter portion, a third position at which the engagement claw is engaged when the signal connection pin is slid from the second position is existent between the first position and the second position, convex portions are formed between the second position and the third position to ensure that the interval between them becomes slightly smaller than the width of the small-diameter portion, and circular holes extending through a rib-like projection portion and the bottom are formed in the vicinity of the convex portions at positions where they partially overlap with the rib-like projection portion for stabilizing the sliding track, formed to surround the through hole.

In the present invention constituted as described above, after the above signal connection pin is inserted into the above through hole at the above first position having an opening diameter wide enough to accept the above signal connection pin, the signal connection pin is slid to the second position having a slightly small opening diameter by aligning the above through hole with the above small-diameter portion in height in the axial direction of the above signal connection pin so that the above small-diameter portion is loosely mated with the through hole. Further, a member having the above through hole and the other member are assembled together to form a cabinet, the seal plate provided on the other member covers part of the above through hole to prevent the above signal connection pin from sliding to the above first position. Therefore, the above signal connection pin cannot slip out from the through hole and is held in the cabinet.

The above connection pin is inserted into the connection jack formed in the external TV cabinet while it is held in the above cabinet and electrically connected to the connection jack, and the above speaker is slid over the TV cabinet while this connection is maintained to engage an engagement claw formed on the cabinet with the above TV cabinet. The small-diameter portion of the above connection pin slides from the second position to the third position over the convex portions the interval between which is slightly smaller than the width of the small-diameter portion and which are formed between the second position and the third position.

When the above small-diameter portion of the above connection pin slides over the convex portions the interval between which is slightly smaller than the width of the above small-diameter portion, the rib-like projection portion formed to surround the through hole contacts the side surface of the connection pin to guide the sliding of the connection pin, whereby the sliding track is stabilized and the connection pin can be slid stably. Further, the circular holes extending to the bottom of the cabinet are formed in the vicinity of the above convex portions at positions where they partially overlap with the above projection portion. Therefore, the above convex portions are deformed to increase the interval therebetween so that the above small-diameter portion can pass thereby and the above connection pin can slide without wearing away the contact portions of the connection pin and the through hole. Further, the speaker is fixed to the cabinet with a screw hole formed in the cabinet.

According to another embodiment of the present invention, there is provided a speaker which comprises a signal connection pin having a columnar shape with substantially the same diameter and a small-diameter portion at a halfway position in an axial direction, a speaker unit electrically connected to the connection pin by a wire, and a cabinet for holding the speaker unit, the signal connection pin and the wire, and which can be mounted to an external TV cabinet, wherein a prolonged through hole into which the signal connection pin is inserted and slid is formed in the bottom of the cabinet, one end of the through hole is made a first position having an opening diameter wide enough to accept the signal connection pin, the other end of the through hole is made a second position having a slightly small opening diameter so that it is loosely mated with the small-diameter portion, a third position for holding the small-diameter portion is existent between the first position and the second position, convex portions are formed between the second position and the third position to ensure that the interval between them becomes slightly smaller than the width of the small-diameter portion, and cushion holes extending to the bottom are formed in the vicinity of the convex portions.

When the speaker is constituted as describe above, after the above connection pin is inserted into the above through hole at the first position having an opening diameter wide enough to accept the above signal connection pin, it is slid to the second position having a slightly small opening diameter while the through hole is aligned with the above small-diameter portion in height in the axial direction of the signal connection pin so that the above small-diameter portion is loosely mated with the through hole. Therefore, the above connection pin is held in the above cabinet. Further, the above small-diameter portion of the above connection pin is slid from the second position to the third position over the convex portions the interval between which is slightly smaller than the width of the small-diameter portion and which are formed between the second position and the third position of the above opening. To slide the above small-diameter portion of the above connection pin over the convex portions the interval between which is slightly smaller than the width of the small-diameter portion, the cushion holes extending to the bottom of the cabinet are deformed to increase the interval between the above convex portions so that the above small-diameter portion can pass thereby, whereby the above connection pin slides without the wear of the contact portions of the connection pin and the through hole.

As described above, according to the present invention, there can be provided a speaker which is so durable that it is rarely worn away even when it is detached repeatedly.

According to still another embodiment of the present invention, a rib-like projection portion for stabilizing the sliding track of the above signal connection pin may be formed to surround the above through hole.

According to the above constitution, as the above rib-like projection portion contacts the side surface of the above connection pin to guide the sliding of the connection pin, the sliding track is fixed and the connection pin can be slid stably.

According to a further embodiment of the present invention, the above cushion holes partially overlap with the above rib-like projection portion and the overlapped portions extend through the cabinet.

According to the above constitution, when the small-diameter portion of the above connection pin passes by the convex portions the interval between which is slightly smaller than the width of the small-diameter portion, the connection pin does not contact the above projection portion because the above overlapped portions of the projection portion extend through the cabinet. That is, since stress between the above connection pin and the projection portion is released, the above cushion holes are easily deformed so that the small-diameter portion of the above connection pin can pass by the above convex portions.

Thus, the cushion holes can be easily deformed.

According to a still further embodiment of the present invention, the above cabinet has an engagement claw to be engaged with the TV cabinet by sliding the above connection pin from the second position to the third position.

According to this constitution, since the above engagement claw provided on the above cabinet does not engage with the TV cabinet when the above connection pin is existent at the second position, the above connection pin can be inserted into the above connection jack. When the speaker is slid so that the above connection pin slides to the third position, the above engagement claw engages with the TV cabinet to fix the speaker to the TV cabinet.

Thus, the speaker can be fixed with a good appearance without increasing the number of parts.

According to a still further embodiment of the present invention, after the engagement claw is engaged with the TV cabinet, the speaker is further fixed to the TV cabinet by a screw.

According to the above constitution, after the speaker is fixed to the above TV cabinet by the screw, the speaker cannot be slid, whereby the engaged state of the above engagement claw is not canceled accidentally.

According to a still further embodiment of the present invention, in the assembly state of the speaker, the seal plate for preventing the pin from sliding to the first position of the through hole is provided to cover a predetermined part of the through hole.

According to the above constitution, since the sliding of the pin to the first position is prevented in the assembly state of the speaker, the above connection pin does not slip out from the through hole.

According to a still further embodiment of the present invention, the above cushion holes are circular holes and formed along the outer edge of the through hole.

According to the above constitution, even when the connection pin slides and the above cushion holes are deformed, the concentration of stress on parts of the cushion holes is prevented.

According to a still further embodiment of the present invention, the above circular holes are prolonged holes and formed along the outer edge of the through hole.

According to the above constitution, since the prolonged holes are formed along the outer edge of the through hole, the deformation range of the connection pin when it slides is wide, whereby the connection pin is easily deformed.

This can increase the amount of deformation.

DESCRIPTION OF THE PREFERRED EMBODIMENTS

Preferred embodiment of the present invention will be described according to the following order.

Figure 1:
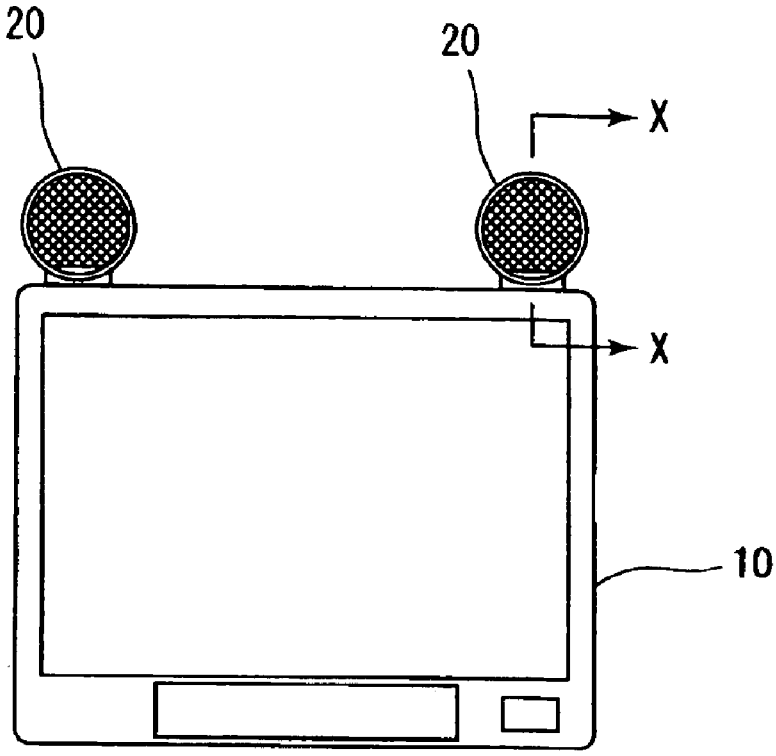
FIG. 1 is a front view of a speaker according to an embodiment of the present invention.
Figure 2:
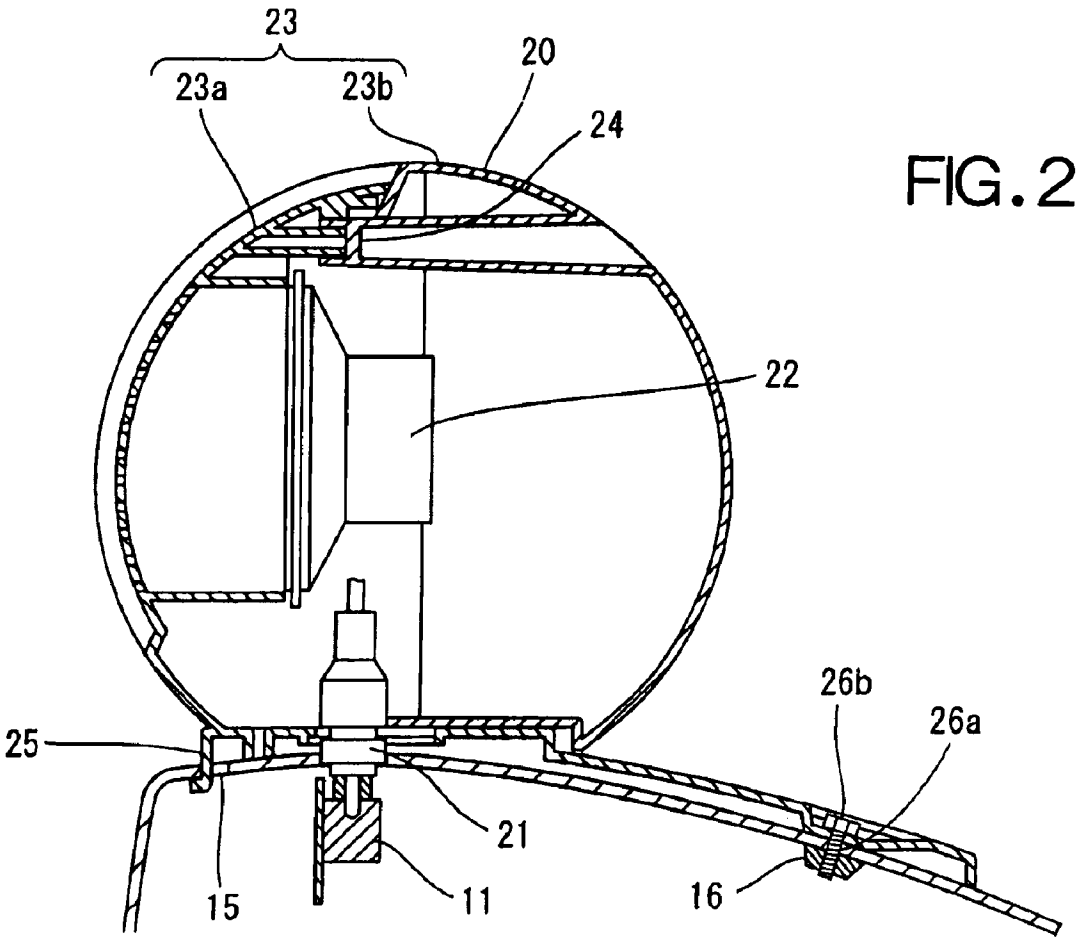
FIG. 2 is an X—X sectional view of the speaker according to the embodiment of the present invention.

(1) constitution of the speaker:

(2) assembly method:

(3) mounting method:

(4) variation:

(1) Constitution of the Speaker:

FIG. 1 is a front view of a speaker according to an embodiment of the present invention. In FIG. 1, the speaker 20 is mounted on right and left sides of the top of a TV 10. FIG. 2 is an X—X sectional view of the speaker 20 shown in FIG. 1. In FIG. 2, a substantially spherical synthetic resin cabinet 23 forming the shell of the speaker 20 contains a speaker unit 22. The cabinet 23 is formed by fixing a substantially semispherical front member 23*a* and a rear member 23*b* by a screw at a screw fixing portion 24. Since the speaker unit 22 and a connection pin 21 are electrically connected to each other by an unshown wire, a sound signal or the like can be transmitted.

Further, the connection pin 21 is inserted into a connection jack 11 formed in a TV cabinet 13 through the bottom opposed to the TV cabinet 13 of the cabinet 23. The connection jack 11 is electrically connected to a sound circuit provided in the TV 10 by an unshown wire or the like. Therefore, since a sound signal from the sound circuit of the TV 10 is transmitted to the speaker unit 22 through the connection jack 11 and the connection pin 21, the speaker 20 can produce a sound according to the sound output of the TV 10.

An engagement claw 25 projects downward at the front of the cabinet 23 and is engaged with an opening 15 formed in the TV cabinet 13. A screw hole 26*a* is formed in the rear portion of the cabinet 23, a threaded hole 16 is formed in a portion right below the screw hole 26*a* of the TV cabinet 13, and a common screw 26*b* is screwed into the screw hole 26*a* and the threaded hole 16.

Figure 3:
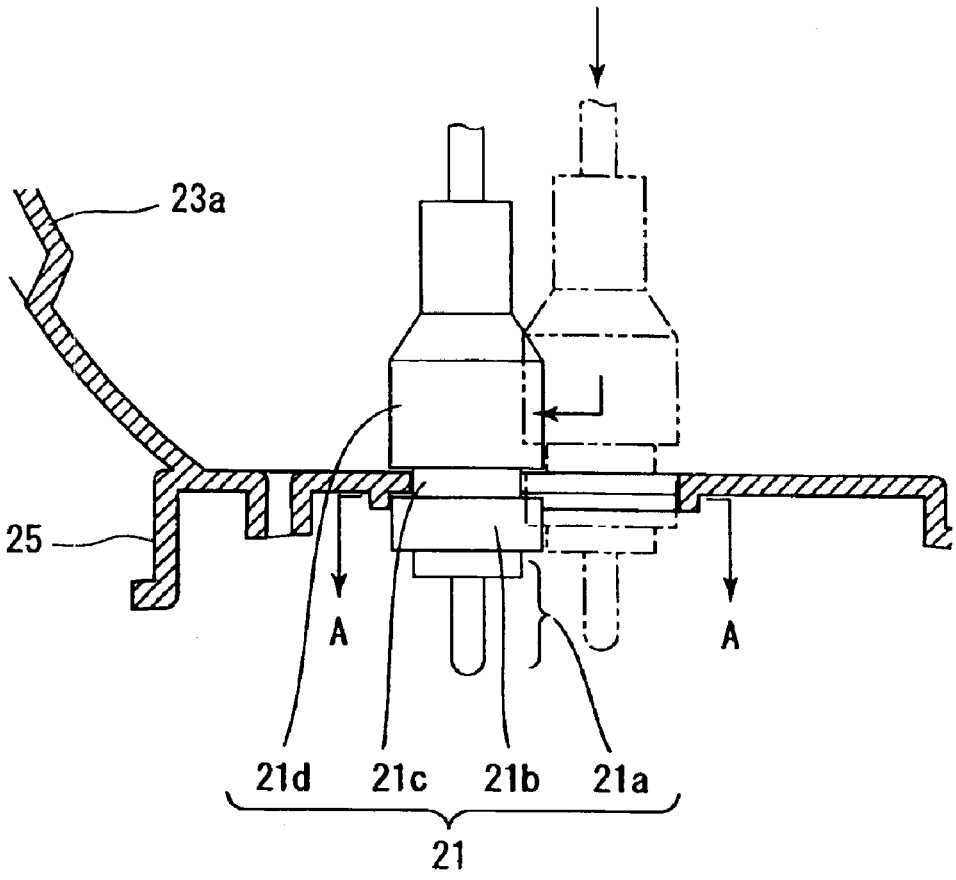
FIG. 3 are sectional views showing that a connection pin is fitted in the speaker according to the embodiment of the present invention.
Figure 3:
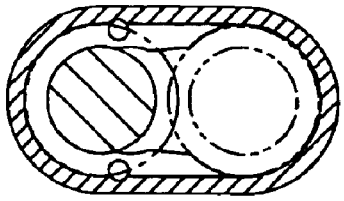

(2) Assembly Method:

The upper diagram of FIG. 3 is a sectional view cut on X—X of FIG. 1 showing that the connection pin 21 is set in the front member 23*a* of the cabinet 23 in the production process of the speaker 20. The lower diagram of FIG. 3 is a sectional view cut on A—A shown in the upper diagram of FIG. 3. The rear member 23*b* is not assembled with the substantially semispherical front member 23*a* yet. In the upper diagram of FIG. 3, as for large-diameter portions and small-diameter portions of the connection pin 21, from the bottom in the axial direction of the connection pin 21, the connection pin 21 comprises a terminal portion 21*a* formed of a good conductor, a first large-diameter portion 21*b* made of a synthetic resin, a small-diameter portion 21*c*, and a second large-diameter portion 21*d* having the same diameter as the first large-diameter portion 21*b*, the centers of the horizontal sections of which are all aligned with the axis. A substantially oval through hole 28 is formed in the bottom of the front member 23*a* so that the connection pin 21 can be inserted thereinto. The height of the small-diameter portion 21*c* is slightly larger than the thickness of the through hole 28.

Figure 4:
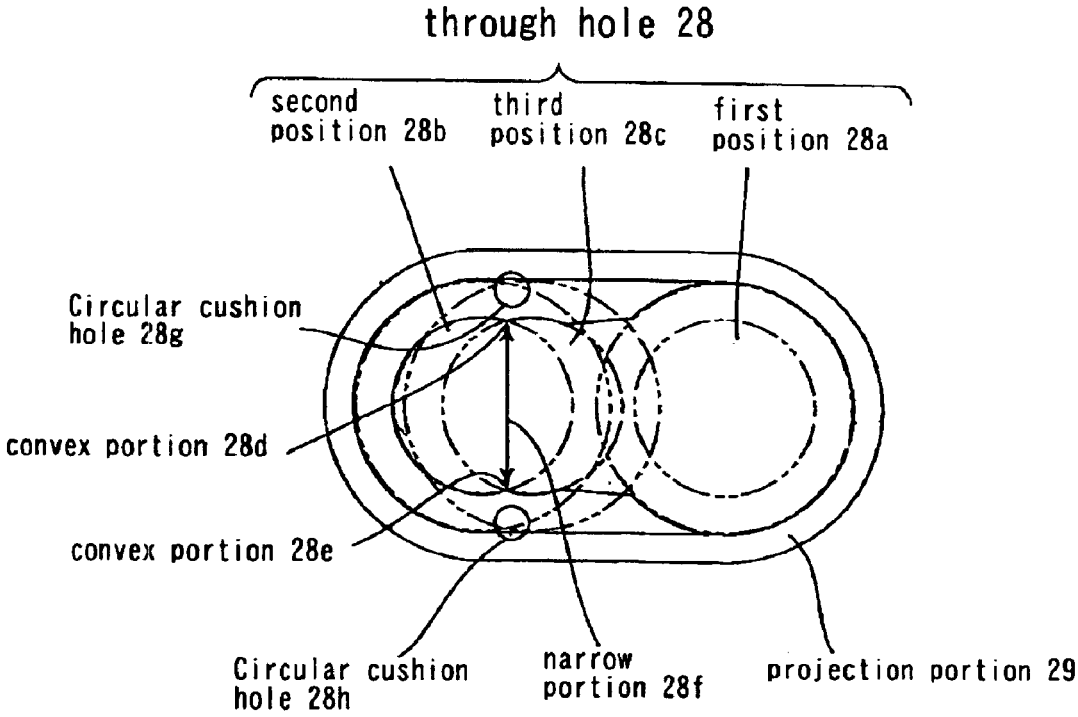
FIG. 4 is a diagram showing the bottom of the speaker according to the embodiment of the present invention when seen from below.

FIG. 4 is an enlarged view of the above through hole 28 when seen from the bottom of the front member 23*a*. In FIG. 4, a substantially circular first position 28*a* having a diameter wide enough to be loosely mated with the first large-diameter portion 21*b* and the second large-diameter portion 21*d* of the above connection pin 21 is formed in the right end portion on the sheet of the through hole 28, a substantially circular second position 28*b* having a diameter wide enough to be loosely mated with the small-diameter portion 21*c* of the above connection pin 21 is formed in the left end portion on the sheet of the through hole 28, and a substantially circular third position 28*c* having a diameter wide enough to be loosely mated with the small-diameter portion 21*c* of the above connection pin 21 is formed between the above first position 28*a* and the second position 28*b*. Since the centers of the circles of the first position 28*a*, the second position 28*b* and the third position 28*c* are aligned with one another, and the second position 28*b* and the third position 28*c* have a predetermined overlapped portion, a narrow portion 28*f* having a smaller width than the diameter of the small-diameter portion 21*c* of the above connection pin 21 is formed between convex portions 28*d* and 28*e* formed at the top and the bottom in the vertical direction of the sheet of the overlapped portion inevitably.

The right end portion on the sheet of FIG. 4 is circumscribed to the right half on the sheet of the circle of the first position 28*a*, the left end portion on the sheet has its center at the center of the second position 28*b* shown by a broken line and circumscribed to the left half on the sheet of a circle having the same diameter as the first large-diameter portion 21*b*, and a rib-like projection portion 29 formed by connecting the above half portions of the circles project downward from the cabinet 23. Circular cushion holes 28*g* and 28*h* are formed above the convex portion 28*d* on the sheet and below the projection portion 28*e* on the sheet through the projection portion 29 from the bottom at positions where they partially overlap with the projection portion 29, respectively.

According to the above constitution, as shown by a broken line in FIG. 3, the connection pin 21 is inserted into the first position of the through hole 28 through which the large-diameter portion 21*b* can pass and projected downward from the cabinet 23. The connection pin 21 is further inserted until the small-diameter portion 21*c* is aligned with the through hole 28 in height, the small-diameter portion 21*c* is contacted to the left end on the sheet of the through hole 28, and the first large-diameter portion can be slid to a position where it is inscribed in the left end portion on the sheet of the projection portion. That is, the connection pin 21 can be moved to the second position 28*b* while it is projected from the cabinet 23. Since the narrow portion 28*f* having a smaller width than the diameter of the small-diameter portion 21*c* and sandwiched between the convex portions 28*d* and 28*e* is formed between the second position 28*b* and the third position 28*c*, the connection pin 21 does not move between the both positions accidentally. As a matter of course, since a portion having a smaller width than the first and second large-diameter portions 21*b* and 21*d* is slid, the connection pin 21 does not plunge into the cabinet 23 or does not slip out from the cabinet 23 while it is sliding or after it slides when it is existent at the second position 28*b*. Further, when the connection pin 21 slides, the first large-diameter portion 21*b* contacts the projection portion 29, thereby stabilizing the track of the connection pin 23.

Figure 5:
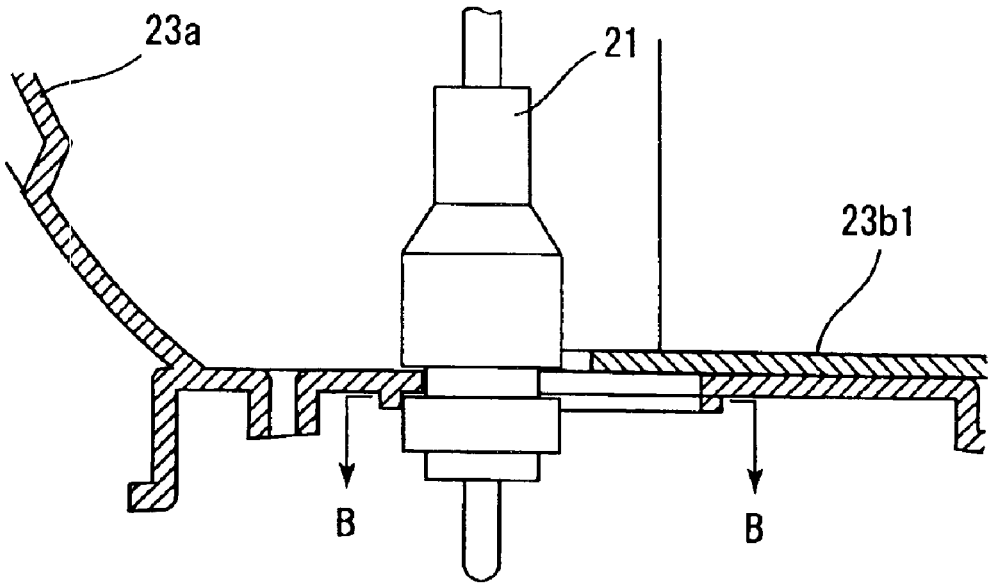
FIG. 5 are sectional views showing that the speaker according to the embodiment of the present invention is assembled.
Figure 5:
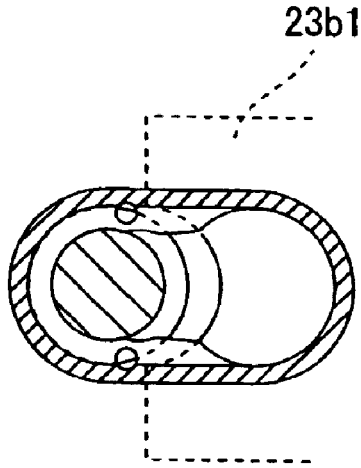

FIG. 5 shows that after the end of the above-described movement of the connection pin, the rear member 23*b* is assembled with the substantially semispherical front member 23*a*. Like FIG. 3, the upper diagram of FIG. 5 is a sectional view cut on X—X of FIG. 1 and the lower diagram of FIG. 5 is a sectional view cut on B—B of the upper diagram. In the lower diagram, a seal plate 23*b*1 molded together with the rear member 23*b* covers part of the through hole 28 from the inside of the cabinet 23. The portion covered by the seal plate 23*b*1 of the through hole 28 prevents the connection pin 21 from sliding to the first position 28*a* by contacting the second large-diameter portion of the connection pin 21 to the end face of the seal plate 23*b*1.

Owing to this constitution, after the rear member 23*b* is assembled with the front member 23*a*, the connection pin 21 does not slide to the first position 28*a*, thereby making it possible to prevent the connection pin 21 from slipping out from the cabinet 23 accidentally. Therefore, since the assembly of the front member 23*a* and the rear member 23*b* is completed at the time of shipment, the connection pin 21 does not slip out when the speaker is used by a user.

Figure 6:
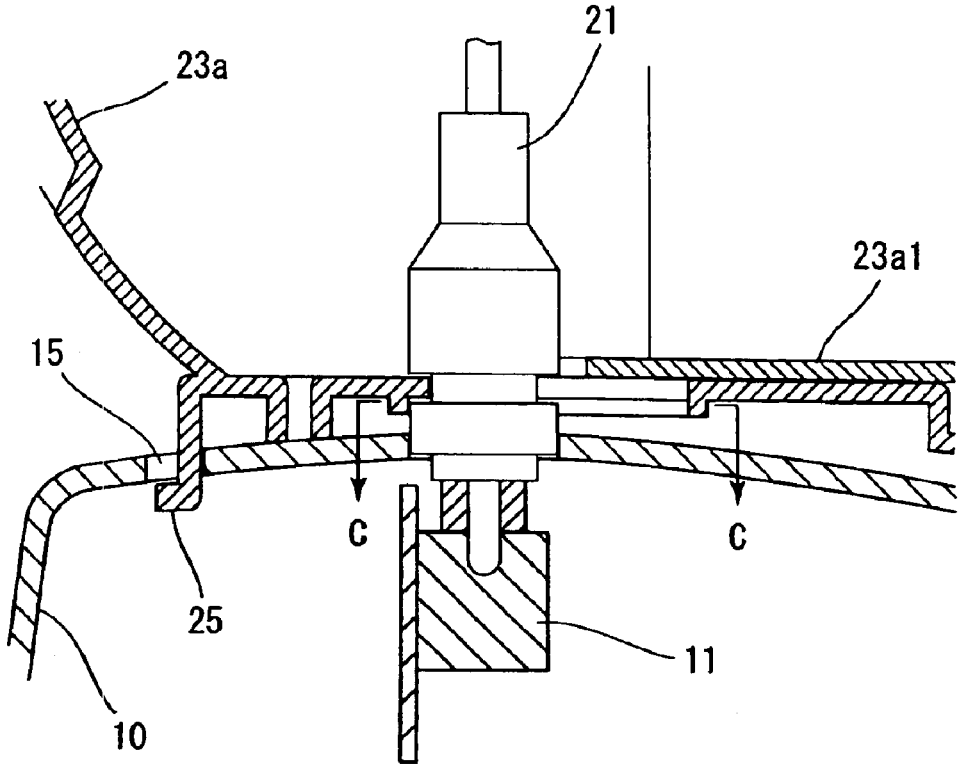
FIG. 6 are sectional views showing that the speaker according to the embodiment of the present invention is mounted on a TV.
Figure 6:
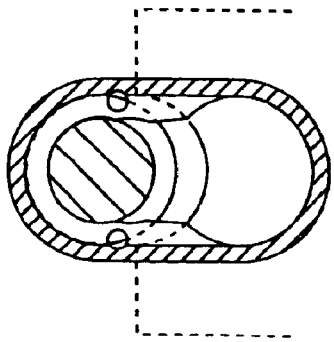

(3) Mounting Method:

FIG. 6 shows that after the rear member 23*b* is assembled with the front member 23*a*, the speaker 20 is electrically connected to the TV 10. Like FIG. 3, the upper diagram of FIG. 6 is a sectional view cut on X—X of FIG. 1 and the lower diagram is a sectional view cut on C—C of the upper diagram. In the upper diagram, by lowering the speaker 20 toward the TV 10, the terminal portion 21*a* of the connection pin 21 is inserted into the connection jack 11 formed in the TV 10 while the connection pin 21 maintains its relative position with the cabinet 23. The engagement claw 25 formed at the front of the cabinet 23 is inserted into the opening 15 formed in the TV cabinet without being engaged with the opening 15.

Since the TV 10 is electrically connected to the speaker 20 by this constitution, the speaker unit 22 can make a sound according to a sound signal output from the sound circuit of the TV.

Figure 7:
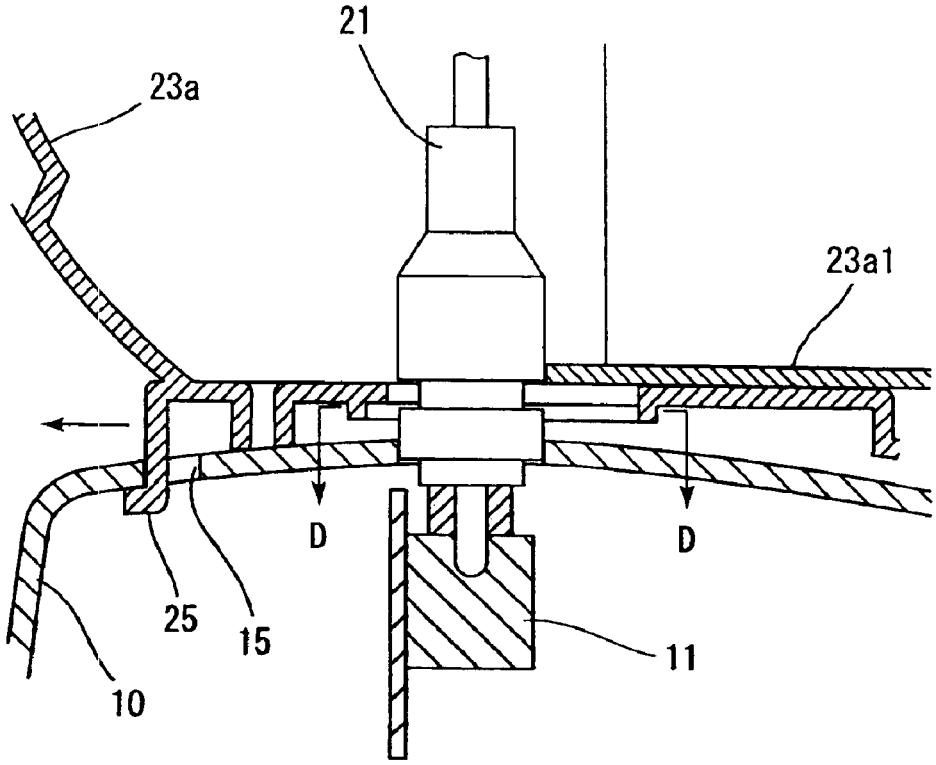
FIG. 7 are sectional views showing that the speaker according to the embodiment of the present invention is mounted on the TV.
Figure 7:
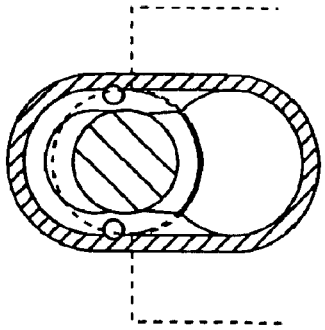

FIG. 7 shows that the speaker is fixed in the TV 10. Like FIG. 3, the upper diagram of FIG. 7 is a sectional view cut on X—X of FIG. 1 and the lower diagram is a sectional view cut on D—D of the upper diagram. In the lower diagram, the small-diameter portion 21*c* of the connection pin 21 is moved to the third position 28*c*. That is, the speaker 20 is slid by the moving distance of the small-diameter portion 21*c* from the second position 28*b* to the third position 28*c*. The engagement claw 25 also moves forward in the opening 15 and engages with the TV cabinet to fix the front portion of the speaker 20. At the same time, the screw hole 26*a* formed in the rear portion of the cabinet 23 and the threaded hole 16 formed in the TV cabinet 13 shown in FIG. 2 are aligned with each other and mated with each other by the common screw 26*b*.

By this constitution, the speaker 20 is fixed in the TV 10. Further, since the front side of the speaker 20 which is in the sight of the user is fixed by the engagement claw 25, the screw is not exposed and therefore, the speaker 20 looks nice. Consequently, as a step for hiding the screw to ensure a good appearance is not necessary, the complex structure of a member or an increase in the number of parts can be eliminated.

However, in the constitutions of the above speaker and TV, when the speaker 20 is mounted and fixed on top of the TV 10, the TV becomes too bulky for shipping or packaging. Further, there is a case where the user likes to output a sound by connecting the sound output terminal of the TV 10 to an external device such as an amplifier. In this case, the speaker 20 becomes unnecessary. Therefore, the speaker 20 is desirably detachable repeatedly as required. When it is detached repeatedly, shift from the state of FIG. 6 to the state of FIG. 7 is repeated. That is, the small-diameter portion 21*c* of the connection pin 21 moves between the second position 28*b* and the third position 28*c* of the through hole 28 repeatedly.

Figure 8:
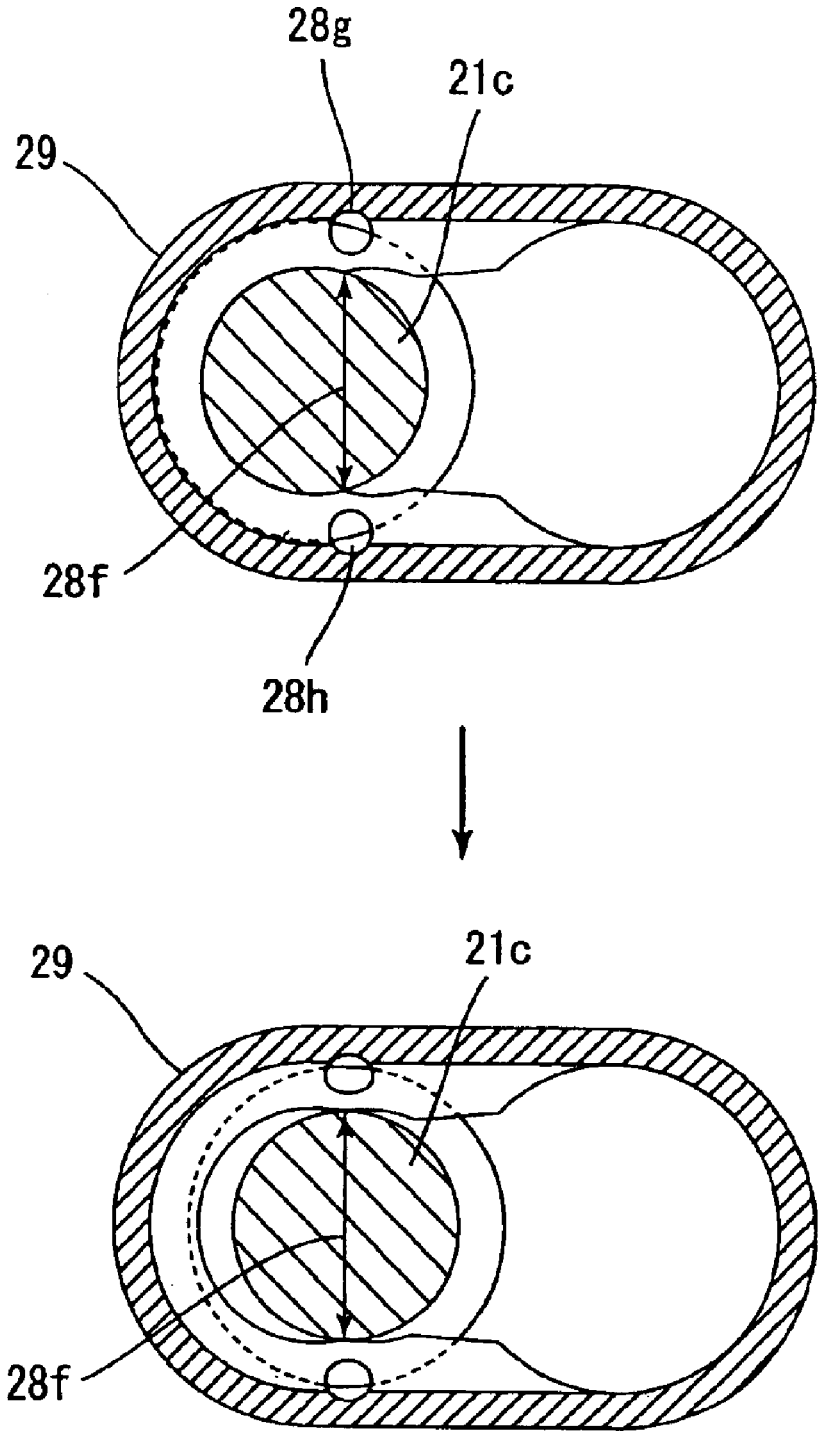
FIG. 8 are enlarged views showing that the speaker according to the embodiment of the present invention is mounted on the TV when seen from the bottom.

FIGS. 8 are diagrams showing that the small-diameter portion 21*c* of the connection pin 21 moves between the second position 28*b* and the third position 28*c* of the through hole 28 when seen from the bottom. In the lower diagram of FIG. 8, the small-diameter portion 21*c* of the connection pin 21 passes through the narrow portion 28*f* formed between the second position 28*b* and the third position 28*c*. The circular cushion holes 28*g* and 28*h* formed near the narrow portion 28*f* in the upper diagram are deformed in the horizontal direction. Since the large-diameter portion 21*b* shown by a broken line passes by portions overlapping with the cushion holes 28*g* and 28*h* of the projection portion 29, it does not contact the projection portion 29.

Even when the small-diameter portion 21*c* of the connection pin 21 moves between the second position 28*b* and the third position 28*c* repeatedly, the contact portions of the convex portions 28*d* and 28*e* of the through hole 28 and the small-diameter portion 21*c* can be hardly worn away by this constitution. To enable the small-diameter portion 21*c* of the connection pin 21 to pass through the narrow portion 28*f*, the narrow portion 28*f* must be deformed to such an extent that its width is increased to the diameter of the small-diameter portion 21*c*. Further, if the above deformation is not elastic deformation, after the connection pin 21 passes through the narrow portion 28*f*, the narrow portion 28*f* cannot restore its original width or any one of the members is broken or worn away. Therefore, the small-diameter portion 21*c* slides between the second position 28*b* and the third position 28*c* accidentally after that. That is, the engagement state and disengagement state of the engagement claw 25 cannot be maintained and detaching work becomes difficult.

As the cushion holes 28*g* and 28*h* are formed in this embodiment, portions sandwiched between the cushion holes and the narrow portion 28*f* are widely and elastically deformed so that the cushion holes are deformed in the horizontal direction, thereby changing the width of the narrow portion 28*f*. That is, since the amount of elastic deformation increases as the deformation area becomes larger, a structure that can be deformed with a margin is obtained. Further, as the cushion holes 28*g* and 28*h* are circular holes, when they deform, they rarely crack without the concentration of stress in a corner portion or the like. Since the large-diameter portion 21*b* does not contact the projection portion 29 when the cushion holes 28*g* and 28*h* deform, stress applied to portions around the cushion holes 28*g* and 28*h* by pressing the large-diameter portion 21*b* is eased, whereby the above portions easily deform. Therefore, even when the speaker is detached repeatedly, the wear of the contact portions hardly occurs and the narrow portion 28*f* can be elastically returned to its original width, thereby obtaining the mated state again. Consequently, the speaker does not slide accidentally. For example, such inconvenience does not occur that the connection pin 21 slides to the third position 28*c* and therefore is mated again without being noticed by anyone and cannot be pulled out although the small-diameter portion 21*c* is slid to the second position 28*b* to pull the connection pin 21 of the speaker from the connection jack 11.

Figure 9:
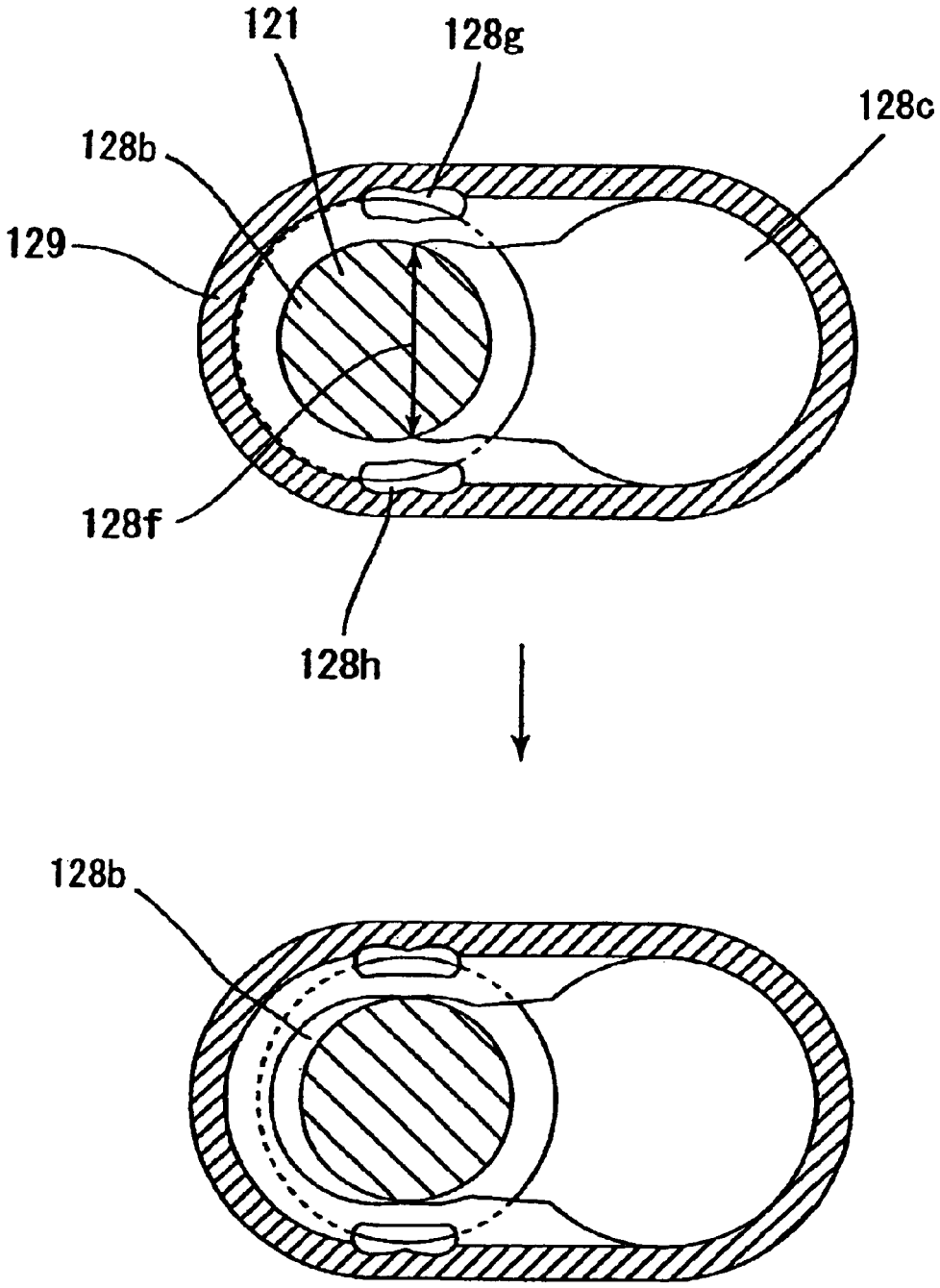
FIG. 9 are enlarged views showing a speaker according to a second embodiment of the present invention is mounted on a TV when seen from the bottom.

(4) Variation:

FIGS. 9 are diagrams showing that the small-diameter portion of a connection pin 121 according to a second embodiment moves between the second position 128*b* and the third position 128*c* of a through hole 128 when seen from the bottom. In FIGS. 9, prolonged cushion holes 128*g* and 128*h* are formed. Therefore, portions which are deformed by increasing the width of the above narrow portion 128*f* become large along the cushion holes 128*g* and 128*h*, thereby making it possible to increase the deformation of the narrow portion 128*f* in accordance with the design requirement. Further, as the cushion holes have no corners in this embodiment, they rarely crack without the concentration of stress at the time of deformation.

We claim:

1. A speaker comprising a signal connection pin having a columnar shape with substantially the same diameter and a small-diameter portion at a halfway position in an axial direction, a speaker unit electrically connected to the connection pin by a wire, and a cabinet for holding the speaker unit, the signal connection pin and the wire, the signal connection pin being slid over an external TV cabinet while it is connected to a connection jack formed in the TV cabinet so that an engagement claw formed on the cabinet engages with the TV cabinet, and further the speaker being fixed by a screw, wherein a prolonged through hole into which the signal connection pin is inserted and slid is formed in the bottom of the cabinet, one end of the through hole is made a first position which is an opening for preventing the signal connection pin from sliding by means of a seal plate provided on other member in an assembly state, having a diameter wide enough to accept the signal connection pin, the other end of the through hole is made a second position having a slightly small opening diameter so that it is loosely mated with the small-diameter portion, a third position at which the engagement claw is engaged when the signal connection pin is slid from the second position is existent between the first position and the second position, convex portions are formed between the second position and the third position to ensure that the interval between them becomes slightly smaller than the width of the small-diameter portion, and circular holes extending through a rib-shaped projection portion and the bottom are formed in the vicinity of the convex portions at positions where they partially overlap with the rib-shaped projection portion for stabilizing the sliding track of the signal connection pin, formed to surround the through hole.

2. A speaker comprising a signal connection pin having a columnar shape with substantially the same diameter and a small-diameter portion at a halfway position in an axial direction, a speaker unit electrically connected to the connection pin by a wire, and a cabinet for holding the speaker unit, the signal connection pin and the wire, and which can be mounted on an external TV cabinet, wherein a prolonged through hole into which the signal connection pin is inserted and slid is formed in the bottom of the cabinet, one end of the through hole is made a first position having an opening diameter wide enough to accept the signal connection pin, the other end of the through hole is made a second position having a slightly small opening diameter so that it is loosely mated with the small-diameter portion, a third position for holding the small-diameter portion is existent between the first position and the second position, convex portions are formed between the second position and the third position to ensure that the interval between them becomes slightly smaller than the width of the small-diameter portion, and cushion holes extending to the bottom of the cabinet are formed in the vicinity of the convex portions.

3. The speaker of claim 2, further comprising the cushion holes extending through a rib-shaped projection portion, wherein the rib-like projection portion for fixing the sliding track of the signal connection pin is formed to surround the through hole.

4. The speaker of claim 3, wherein the cushion holes partially overlap with the rib-shaped projection portion and extend through the overlapped portions.

5. The speaker of claim 2, wherein the cabinet is provided with an engagement claw to be mated with the TV cabinet by sliding the connection pin from the second position to the third position.

6. The speaker of claim 5, wherein after the speaker is engaged with the TV cabinet by the engagement claw, it is further screwed to the TV cabinet.

7. The speaker of claim 2, wherein a seal plate for preventing the pin from sliding to the first position of the through hole covers a predetermined part of the through hole in the assembly state of the speaker.

8. The speaker of claim 2, wherein the cushion holes are circular holes.

9. The speaker of claim 8, wherein the circular holes are prolonged holes and formed along the outer edge of the through hole.

* * * * *